US008060992B2

(12) United States Patent
Koch et al.

(10) Patent No.: US 8,060,992 B2
(45) Date of Patent: Nov. 22, 2011

(54) RESEALABLE SEALS AND DOCKING SYSTEMS CONTAINING THESE SEALS

(75) Inventors: Martin Koch, Neuenburg (DE); Ed Piepereit, Nr Evesham (GB)

(73) Assignee: Gea Pharma Systems AG (CH)

( * ) Notice: Subject to any disclaimer, the term of this patent is extended or adjusted under 35 U.S.C. 154(b) by 793 days.

(21) Appl. No.: 10/586,695

(22) PCT Filed: Jan. 21, 2005

(86) PCT No.: PCT/DE2005/000084

§ 371 (c)(1),
(2), (4) Date: Jul. 17, 2008

(87) PCT Pub. No.: WO2005/070776

PCT Pub. Date: Aug. 4, 2005

(65) Prior Publication Data

US 2008/0276435 A1 Nov. 13, 2008

(30) Foreign Application Priority Data

Jan. 23, 2004 (DE) ..... 10 2004 003 511

(51) Int. Cl.
*B65D 33/25* (2006.01)

(52) U.S. Cl. ..... 24/384; 24/386; 24/399; 24/400

(58) Field of Classification Search ..... 24/382–384, 24/386, 30.5 R, 399, 400; 383/37, 61.3, 383/64; 141/10, 313, 315, 319, 302, 383, 141/114

See application file for complete search history.

(56) References Cited

U.S. PATENT DOCUMENTS

| | | | | |
|---|---|---|---|---|
| 4,485,534 | A * | 12/1984 | Pilie et al. | 24/384 |
| 5,664,299 | A | 9/1997 | Porchia et al. | |
| 2002/0184740 | A1 * | 12/2002 | Meager | 24/389 |
| 2005/0084181 | A1 | 4/2005 | Koch et al. | |

FOREIGN PATENT DOCUMENTS

| | | |
|---|---|---|
| DE | 695 04 581 | 4/1999 |
| WO | WO 03/037717 | 5/2003 |

* cited by examiner

*Primary Examiner* — James Brittain
(74) *Attorney, Agent, or Firm* — Schiff Hardin LLP

(57) ABSTRACT

A docking seal system has a first flexible enclosure with a first coupling seal and a second flexible enclosure with a second coupling seal. Each of the coupling seals has first and second sealing strips. A first zip slide is engageable with the first and second sealing strips of the first coupling seal and a second zip slide is engageable with the first and second sealing strips of the second coupling seal so that the respective first and second coupling seals can be opened and closed. The first and second zip slides are each combined with a respective portion of a coupling slide to form respective combined slides. When the combined slides are combined together, the respective portions of the coupling slides mate together to form the coupling slide, the coupling slide engaging or disengaging the first and second coupling seals so as to dock or separate the first and second flexible enclosures from one another.

21 Claims, 7 Drawing Sheets

RESEALABLE SEALS AND DOCKING SYSTEMS CONTAINING THESE SEALS

BACKGROUND

The present preferred embodiment relates to reclosable seals for substantially environmentally impermeable, reversible sealing as well as for substantially environmentally impermeable filling and/or decanting of bulk material from containers or tube elements and docking systems containing these reclosable seals.

In addition, the preferred embodiment relates to multiple coupling seals containing the inventive reclosable seals, as well as to multiple docking systems containing these multiple coupling seals.

As a rule very high demands with respect to ongoing reliability and environmental sealing are placed on seals or respectively coupling seals, which are used for decanting of bulk material made of e.g. flexible containers. For many bulk materials in minimal quantities are already toxic for the human organism. In addition, certain bulk materials are very sensitive to air and moisture and must be kept completely separate from surrounding air at every processing stage and naturally also during decanting. Bulk materials for further processing also frequently have to satisfy very high purity criteria and in no way may be contaminated from the outside by any contamination. The necessity to work contamination-free in particular in the food-processing, chemical or pharmaceutical industries results in high equipment and safety-related expense, which inevitably manifests in manufacturing costs.

Bulk material can be decanted for example environmentally impermeably from containers by means of double valve technology, such as described in DE 695 04 581 T2. Such docking mechanisms according to double valve technology are structurally highly intricate and thus generally also costly.

Structurally simpler docking mechanisms, such as those disclosed in PCT/EP02/12010, use e.g. elastically deformable coupling elements, which in each case have a superimposed slot, which is closed in the basic state and can be opened by application of pressure. With this configuration of a docking mechanism particular care is to be exercised that the slots of the juxtaposed coupling elements are of the same length and are superimposed exactly over one another.

The unpublished German patent application with file reference 103 21 814.9 on the other hand discloses a coupling element for environmentally insulated decanting, filling and/or emptying of containers, composed substantially of two flush sealing strips, having at their ends mutually engaging articulated bodies, which can be rotated about common bearing axis elements. The articulated axis elements or respectively articulated caps have to be precisely matched to the shape and size of the bearing element of the sealing strips so as to be able to function permanently and reliably as axis bearings. Opening and closing of this coupling element is accomplished by the opposite articulated bodies being moved towards or respectively away from one another. However, only one limited angle of opening can be achieved with this construction.

For trouble-free operation of conventional docking mechanisms it is not only of significance that the coupling seals of the individual containers in each case can implicitly be closed environmentally impermeably. Rather, it is also of major significance that the coupling seals or elements can be docked problem-free and environmentally impermeably on corresponding coupling elements or seals. This succeeds all the better the smaller and more rigid the individual coupling elements or respectively their constituents, e.g. sealing strips, are. In particular, with structurally simple coupling seals, with large-size coupling seals and with coupling seals formed out of very flexible components, docking onto corresponding coupling seals frequently involves problems, is time-intensive and does not always result in environmentally impermeable docking mechanisms.

SUMMARY

An object is to provide seals for environmentally impermeable filling and/or decanting or emptying of bulk material from containers or conveying equipment, which ensure problem-free and reliable sealing independently of the size and flexibility or respective rigidity of the materials used. An object-is also to provide seals for environmentally impermeable filling and/or decanting or emptying of bulk material from containers or conveying equipment, which can be joined reliably and environmentally impermeably and reversibly to corresponding seals of similar or identical construction, independent of the size and flexibility or respectively rigidity of the materials used.

A docking seal system has a first flexible enclosure with a first coupling seal and a second flexible enclosure with a second coupling seal. Each of the coupling seals has first and second sealing strips. A first zip slide is engageable with the first and second sealing strips of the first coupling seal and a second zip slide is engageable with the first and second sealing strips of the second coupling seal so that the respective first and second coupling seals can be opened and closed. The first and second zip slides are each combined with a respective portion of a coupling slide to form respective combined slides. When the combined slides are combined together, the respective portions of the coupling slides mate together to form the coupling slide, the coupling slide engaging or disengaging the first and second coupling seals so as to dock or separate the first and second flexible enclosures from one another.

DESCRIPTION OF THE PREFERRED EMBODIMENT

Figure 1:
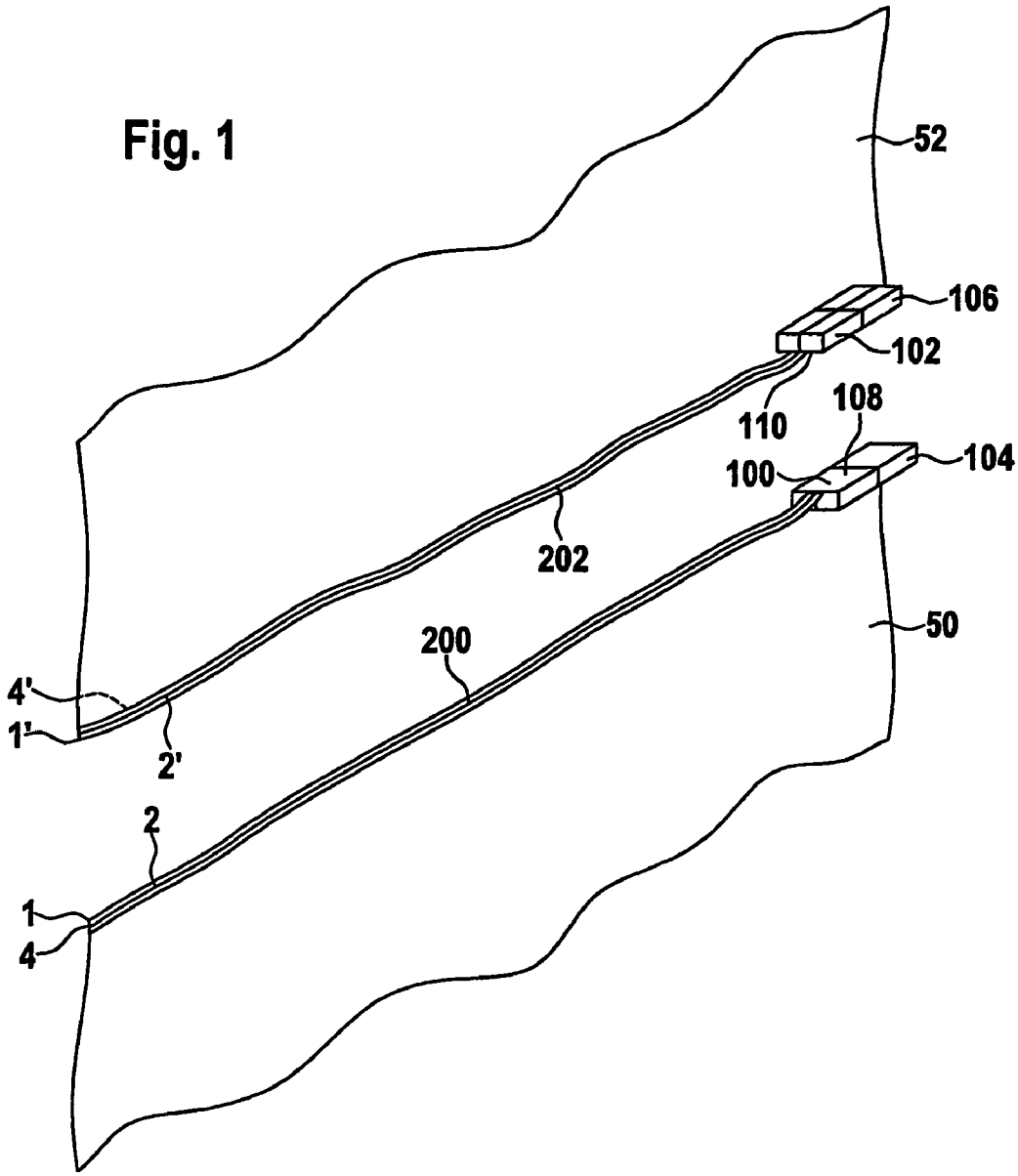
FIG. 1 illustrates two flexible containers of the preferred embodiment to be coupled in a schematic side elevation.

For the purposes of promoting an understanding of the principles of the invention, reference will now be made to preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A reclosable zip seal for reversible sealing of a coupling seal was accordingly found, comprising a coupling seal for substantially environmentally impermeable, reversible sealing as well as for substantially environmentally impermeable filling and/or decanting of bulk material from in particular flexible containers or tube elements, comprising at least one first flexible sealing strip, comprising an inner side and a top side, with at least a first, in particular continuous sealing element, in particular a spring, on its inner side, and at least one second flexible sealing strip, comprising an inner side and a top side, with at least one second, in particular continuous, sealing element on its inner side, in particular a groove, which is complementary to the first sealing element, so that first and second sealing elements can be engaged, and enable reversible, tight sealing of the coupling seal with a further, corresponding coupling seal, whereby the first and the second sealing strip, are connected to one another in particular via their respective end sections, in particular by forming a closed periphery, and whereby the top side of the first sealing strip has at least a third, in particular continuous, sealing element for reversible docking on a complementary sealing element and the top side of the second sealing strip has at least a fourth, in particular continuous, sealing element for reversible docking on a complementary sealing element; and at least one zip slide for opening and closing of the coupling seal, which can be moved along the coupling seal, with a separation end and a compression end and opposite side walls as well as a separating element at the separating end, which can be slid between the first and second sealing elements of the first and second sealing strips, whereby the first and the second sealing element can be engaged in one another in reaction to the movement of the zip slide in a sealing direction from the open position into the closed position and in reaction to the movement of the zip slide can be brought in a direction of opening from the closed position into an open position. The first and second sealing strip of the seal of the preferred embodiment can be interconnected directly or indirectly. By way of example the respective endings or respectively end sections of first and second sealing strip can be connected to one another forming a flexible opening in pairs. In addition, it is possible for the ends of first and second sealing strip to merge into a, for example monobloc, end block, on which the zip slide can be placed in a normal position if necessary. As a consequence, such an end section can also have an end stop for the zip slide. Such an end section can be present on both sides of the opposite ends of first and second sealing strip.

Zip seals for e.g. plastic bags are known e.g. from DE 698 09 569 T2, DE 697 18 439 T2 and DE 696 19 983 T2 and can be used as a starting basis to arrive at a reclosable zip seal of the preferred embodiment. No longer only the inner sides of the first and second sealing strips now have sealing elements corresponding to one another, but likewise their top sides are fitted with sealing elements, which enable environmentally impermeable joining to a second seal of the preferred embodiment, environmentally impermeable filling and/or decanting of bulk material can also be ensured with very flexible bag and/or bead materials. By way of example the coupling seal can be a constituent of a plastic bag and be in the vicinity of the circular opening edge of the same.

The zip seal of the preferred embodiment is suited in particular for filling and/or decanting of bulk material from flexible containers, e.g. plastic bag or sacks. Accordingly, such a zip seal in an embodiment already has a flexible bag or tube, whereof the opening edge is connected separately or monobloc to the first and second sealing strip. The coupling seal can consequently be both an integral constituent of the flexible bags, in particular in the vicinity of the opening edge of this bag, and in retrospect can be connected to a bag reversibly or irreversibly.

The zip slide for opening or closing of the reclosable zip seal generally encroaches on the first and second sealing strip of a coupling seal. The separating element can be slid in between the sealing elements of the first and second sealing strip to open the zip seal. In an embodiment the side walls of the zip slide extend from the sealing face downwards to a point under the first or respectively second sealing strips, so that these sealing strips are held between the side walls. The first and second sealing strips connected to one another at their respective ends or closed positions can also form an end stop. There can also be a fixed station in this position. In a further embodiment the first and second sealing strips of a coupling seal can at least on one side exceed the periphery of a bag or tube connected to this coupling seal, in particular to take up the zip seal in the closed position. This ensures that the coupling seal is sealed over the entire length completely environmentally impermeably.

In the zip slide the sealing elements of the first and second sealing strip are meshed at the compression end. In any case at the compression end the inner distance between the opposite side walls is dimensioned such that it approximately matches the width of the coupled coupling seal. The separated and compression end of the zip slide can of course also be within the zip slide and must not necessarily match the opposite delimiting faces of the zip slide.

In a further embodiment it can be provided that the zip slide, which can be moved between a closed position and an open position along the first and second sealing strips, comprises an upper sealing wall as well as opposite side walls which extend from opposite sides of the sealing wall downwards and which accommodate the first and second sealing strip between them, whereby the side walls run from the separating end to the compression end of the zip slide and are arranged at a greater distance at the separating end than at the compression end, whereby the side walls at the compression end are spaced sufficiently narrowly that when the zip slide moves to the closed position they press the first and second sealing element into mutual engagement, and whereby the separating element protrudes at the separating end from the upper sealing wall between the side walls and past the first and second sealing element.

The underlying object of the preferred embodiment is furthermore solved by a reclosable docking seal for reversible docking of two coupling seals for substantially environmentally impermeable, reversible sealing as well as for substantially environmentally impermeable filling and/or decanting of bulk material from containers or tube elements, comprising a coupling seal, having at least one first flexible sealing strip, comprising an inner side and a top side, with at least a first, in particular continuous, sealing element, in particular a spring, on its inner side and at least one second flexible sealing strip, comprising an inner side and a top side, with at least a second, in particular continuous, sealing element on its inner side, in particular a groove, complementary to the first sealing element and enabling reversible, tight sealing with the first sealing element, whereby first and second sealing elements can be meshed, whereby the first and the second sealing strip, in particular are connected to one another via their respective end sections, in particular by forming closed circumference, and whereby the top side of the first sealing strip has at least a third, in particular continuous, sealing element for reversible docking on a complementary sealing element and the top side of the second sealing strip has at least a fourth, in particular continuous, sealing element for reversible docking on a complementary sealing element; and at least one coupling slide element, encroaching on the first and second sealing strip in sections and which can be moved along the coupling seal, suited for coupling and uncoupling the sealing strips of the coupling seal with the sealing strips of another coupling seal, containing sealing elements, in each case complementary to the third and fourth sealing elements of the sealing strips of the coupling seal of the docking seal.

A preferred configuration of the docking seal of the preferred embodiment is characterized in that the coupling slide element comprises a sealing wall as well as opposite first and second side walls, extending downwards from opposite sides of the sealing wall and taking up the first and second sealing strips between them, a first wall section, lying opposite the sealing wall and going away from the first side wall in the direction of the opposite second side wall, and encroaching on at least a section of the underside of the first flexible sealing strip at least in sections, a second wall section, lying opposite the sealing wall and going away from the second side wall in the direction of the opposite first side wall and encroaching on at least a section of the underside of the second flexible sealing strip at least in sections, whereby at least a gap remains between the first and second wall sections, at least one guide channel for the first and second sealing strip, formed from the opposite side walls, the sealing wall and the first and second sections of walls, and a front wall surface with an inlet opening of the channel and a rear wall surface with a discharge opening of the channel, whereby the inlet and the discharge opening as well as the channel between inlet and discharge opening are suitable for accommodating the first and second sealing strips, whereby that edge of the inlet opening, adjacent to the top sides of first and second sealing strips, is at a distance from the outer surface of the sealing wall and whereby the inner surface of the sealing wall, a constituent of the channel, approaches the outer surface of the sealing wall at least in sections from the inlet opening in the direction of the discharge opening and merges into the latter at the latest at the discharge opening, so that the sealing wall or areas of the sealing wall are no longer there at least over the width of the top sides of the first and second sealing strips, and whereby the height of the channel corresponds approximately to the height of the flexible first and/or second sealing elements at least at the place where the sealing wall assumes zero thickness.

The coupling slide element encroaches on the first and second sealing strip and can be guided along these sealing strips. The channel in the coupling slide element is formed at least in sections such that the meshing first and second sealing strips of the coupling seal substantially are enclosed and fitting precisely. The cross-section of the channel is in each case then only slightly bigger than the cross-section of the coupling seal, so that unhindered gliding through of the coupling seal is still always possible via the coupling slide element. During gliding through of the coupling seal by the coupling slide element the position of the top sides of the sealing strips changes relative to the outer surface of the sealing wall, i.e. reduces from movement in the direction of docking. The top sides of the sealing strips are brought to the height of the outer surface of the sealing wall or respectively then lie in the same plane as that, effectively meaning that the sealing wall has an opening or through-hole. In similar fashion as the channel of the outer surface approaches the sealing wall, the course or respectively the thickness of the first and second sections of wall changes, so that these sections of wall are constantly indirectly adjacent to the respective undersides of the first and second sealing strips. In this way a sealing element present at the top side of the sealing strip, e.g. a spring, can be brought into a corresponding sealing element of an adjacent sealing, e.g. a groove.

By shifting the coupling slide element over or respectively along the sealing strips, each area of the top sides of these sealing strips is in any case brought into a position, so as to be able to be meshed with a corresponding coupling seal of a corresponding seal, likewise fitted with such a coupling slide element.

In a further configuration the reclosable docking seal of the preferred embodiment also comprises at least one zip slide for opening and closing of the coupling seal, which can be moved along the coupling seal, with a separated and a compression end and opposite side walls as well as a separating element at the separating end, which can be slid in between the first and second sealing elements, whereby in reaction to the movement of the zip slide the first and the second sealing element can be meshed together in a sealing direction from the open position into the closed position and in reaction to the movement of the zip slide can be brought in a direction of opening from the closed position into an open position.

In this embodiment, both a coupling slide element and a zip slide, in each case as described hereinabove, can be moved along the first and second sealing strip of the coupling seal. Both these slides can be guided independently of one another, but also together via the coupling seal, resulting in a very large handling clearance for coupling and filling or respectively decanting of containers.

Naturally it is likewise possible that the coupling slide element and the zip slide can be interconnected, in particular reversibly, or that the coupling slide element and the zip slide are integrated in a uniform slide. In the case of an integrated slide both the characteristics of a coupling slide element and the characteristics of a zip slide are present. If such an integrated slide is actuated, two corresponding seals can be joined together by forming a docking mechanism, and at the same time the respective seals can be opened or respectively closed.

In addition, a seal can be provided, which already has a flexible bag or tube, whereof the opening edge is connected tightly to the first and second sealing strip, separately or monobloc.

The danger of contamination can preferably also be further reduced by at least the inner side and/or the top side of the first and/or second sealing strip of the coupling seal having an adhesive layer at least in sections.

In order to simplify and reliably create handling of the coupling seals of the preferred embodiment, it is also an advantage if the first and/or second sealing strip, in particular on the outside, has or respectively have at least one operating grip.

In an effective configuration it is provided that the first and second sealing strip and/or the first and second sealing element are substantially the same length.

The underlying object of the of the preferred embodiment with respect to the environmentally impermeable decanting of bulk material is further solved by a docking system of the preferred embodiment, comprising a first zip seal or a first docking seal and a second zip seal or respectively a second docking seal, whereby the third and fourth sealing elements of the top sides of first and second sealing strip of the first coupling seal of first zip or docking seal are complementary to the third and fourth sealing elements of the top sides of first and second sealing strip of the second coupling seal of second zip or respectively docking seal, so that the first and second sealing strips of first and second coupling seal, in particular environmentally impermeable, can be connected together reversibly and whereby the zip slide of first and second seals and/or the coupling slide elements of first and second seals can be set on one another and/or coupled to one another.

Those embodiments, in which the zip slide of first and second seals and/or the coupling slide elements of first and second seals can be coupled reversibly via corresponding structures, in particular in, at or on their sealing walls, have proven particularly advantageous.

By way of example the zip slide of the first seal can have on its sealing wall a pinched section, into which a bulged section present on the sealing wall of the zip slide of the second seal can be reversibly snap-locked. Meshing zip slide or coupling slide elements of first and second seals permit particularly uncomplicated and reliable handling for opening or respectively closing or docking of containers to be decanted. Of course, e.g. the outer surfaces of the sealing walls of a slide or a coupling slide element of first and second seal can also be fitted with a Velcro seal or a magnet so as to effect temporary connection via this structure.

Accordingly, the docking system of the preferred embodiment comprises two zip seals. Furthermore it is possible to use docking systems, comprising two inventive docking seals, in each case equipped only with at least one coupling slide element. It is particularly advantageous to employ docking systems, in which the first and second seals to be coupled both have at least one zip seal and at least one coupling slide element. Of course, it is likewise possible if only e.g. the first seal has a zip slide and a coupling slide element and the second seal is fitted only with one coupling slide element. The coupling seal, which has in this case no zip seal, can e.g. be opened or closed via operating grips or operating elements arranged on the sealing strips. Furthermore, such docking systems are also of advantage, in which at least one first seal has a zip slide, joined to a coupling slide element or contains the latter as integral constituent. It is of course particularly advantageous if both seals of the docking system are fitted with such coupled or integrated slides.

In addition, it can be provided according to the present preferred embodiment that the first and second coupling seals of first and second seal, the zip slide of first or second seal and/or the coupling slide elements of first and second seal are formed substantially identical or mirror-image.

The object of the preferred embodiment is furthermore solved by a multiple coupling seal for substantially environmentally impermeable, reversible sealing as well as for substantially environmentally impermeable filling and/or decanting of bulk material from flexible and/or rigid containers or conveying structure, comprising at least two first and second seals connected to one another or which can be connected at least in sections in each case via flexible first conveying structure, in each case comprising coupling seals, which can be coupled with coupling seals of corresponding first and second seals, whereby the opening face, in particular the inner diameter, of the opened coupling seal of the first seal is bigger than the outer circumference and/or opening face, in particular the outer and/or inner diameter, of the coupling seal of the second seal, whereby, when the coupling seal of the first seal is opened, the second seal can be docked with a corresponding seal inside the conveying structure and/or at least when entering through the opening of the coupling seal of the first seal in sections by forming a docking mechanism, whereby at least the first seal constitutes a zip seal or a docking seal of the preferred embodiment.

At the same time it is generally provided that the second seal, in particular environmentally impermeable, can be connected or is connected at least in sections to flexible second conveying structure. The second conveying structure accordingly makes a connection, insofar as required, between the second seal and a connected, in particular rigid, container or conveying structure. In a further embodiment it is likewise possible that the first conveying structure is not connected indirectly to the second seal, in particular environmentally impermeable, but that the latter makes a particularly environmentally impermeable connection with the second conveying structure.

Another configuration of the multiple coupling seal of the preferred embodiment provides that the second seal or respectively coupling seal includes a closure flap having a first connecting piece, whereby the closure flap can be brought into a closed position, in which the first end of the connecting piece can be sealed off tightly from the atmosphere. Such systems are disclosed e.g. in DE 695 04 581 T2. Such seals, as disclosed in DE 195 20 409 C1, DE 43 42 962 C1, WO 02/18248 and WO 02/18247 can basically also be used in particular as second seals or respectively coupling seals for the multiple coupling seal of the preferred embodiment. Also, systems as described in WO 03/037756, WO 03/037717 and the unpublished German patent application with the file number 103 21 814.9 are furthermore considered as suitable seals or respectively coupling seals for the multiple coupling seal of the preferred embodiment. Appropriate second seals or respectively coupling seals are likewise described in the still unpublished DE 103 35 325.9.

The multiple coupling seals of the preferred embodiment accordingly have a first coupling seal, forming the inlet opening, and a second or additional coupling seal, to which a container or conveying structure, e.g. a tube, is attached. In the case of the multiple coupling seals adjacent coupling seals are designated such that the one with the larger inner diameter or respectively the larger opening face represents the first coupling seal and the one with the smaller inner surface represents the second coupling seal. Of course, within a multiple coupling seal the adjacent first and second coupling seals can be both of identical structure and different in structure. It is likewise possible that if more than two coupling seals form an inventive multiple coupling seal, the conveying means or respectively tubes connecting the adjacent coupling seals can e.g. be made identical and also different in type, size or length.

In an effective configuration a multiple coupling seal comprises at least one in particular reversible and/or environmentally impermeable connecting device, in particular a Triclamp connection, on at least one coupling seal or a basic element or container connected to a coupling seal, with which the first or second conveying structure can be connected or are connected directly or indirectly, in particular environmentally impermeably, to a coupling seal or the basic element or container connected to this coupling seal.

Two multiple coupling seals can be joined together by forming a multiple docking device. At the same time the actual bulk material transfer takes place via the opened second docking mechanism, i.e. the docking mechanism formed in each case from second coupling seals. The conveying structure or respectively tubes connected to one another via the in each case first coupling seals form a protective sheath, which hermetically shields the first docking mechanism from the outer world at least during the decanting procedure.

The object of the present preferred embodiment therefore likewise includes a multiple docking device, in particular a double docking mechanism, for filling and/or decanting of bulk material, comprising a first and a second multiple coupling seal, whereby the adjacent first seals of first and second multiple coupling seal are coupled or can be coupled to one another by forming a first docking system, in particular environmentally impermeable, and whereby the second seals of first and second multiple coupling seals are coupled or can be coupled to one another by forming a second docking system, in particular environmentally impermeably.

The object of the present preferred embodiment is likewise a container, in particular a flexible container, as well as the conveying structure, in particular a tube, comprising in each case at least one seal.

The object of the present preferred embodiment further comprises a container, in particular a flexible container, which comprises a multiple coupling seal, whereby the coupling seal can be connected or is connected on the discharge opening of the multiple coupling seal to the container indirectly or via a flexible tube element or is an integral constituent of same.

According to a further aspect of the present preferred embodiment the task underlying this preferred embodiment is solved by a method for, in particular environmentally impermeable, filling, decanting and/or emptying of containers and/or with conveying structure, comprising the steps of:

providing flexible first container or conveying structure at least in the opening area, in particular a container or conveying structure, containing at least a first, preferably sealed seal of the preferred embodiment, providing flexible second container or conveying structure at least in the opening area, in particular an container or conveying structure, containing at least a second, preferably sealed seal of the preferred embodiment, joining the slide, in each case comprising coupling slide elements, of first and second seal, so that the first and second sealing strips of the coupling seals of first and second seal can be brought to bear on one another, joint moving of the coupled slide or coupling slide elements of first and second seal along at least in each case of a section of first and second sealing strip of the coupling seals of first and second seal by forming an inventive docking system, joint or time-offset moving of the zip slide of first and second seal in a direction of opening from the closed position into an open position by forming an environmentally impermeable continuous opening between first container or conveying structure and second container or conveying structure, transferring of bulk material from the first container or conveying structure to the second container or conveying structure, or vice versa, joint or time-offset moving of the zip slide of first and second seal into a sealing direction from the open position into a closed position by forming environmentally impermeable first and second seals and retaining an environmentally impermeable docking system, joint moving of the coupled slide or coupling slide elements of first and second seal along at least in each case a section of first and second sealing strip of the coupling seals of first and second seal separating the docking system, in particular retaining environmentally impermeable first and second seals.

At the same time according to the present preferred embodiment it can be provided that with forming and/or separating the docking system the coupling slide elements and the zip slide of first and second seal are moved at the same time, whereby the coupling slide element and the zip slide of the first seal and/or the coupling slide element and the zip slide of the second seal are preferably adjacent indirectly or directly and/or whereby the zip slide of first and second seal abut one another.

In a particularly preferred configuration of the method of the preferred embodiment it is provided that the coupling slide element and the zip slide of the first seal and/or the coupling slide element and the zip slide of the second seal are integrated into one slide.

In a further configuration it is provided that the lengths of first and second sealing strip of the first seal and the lengths of first and second sealing strip of the second seal substantially match.

The underlying task of the preferred embodiment is solved according to a further aspect also by a method for, in particular environmentally impermeable, filling, decanting and/or emptying of containers and/or with conveying structure, comprising the steps of:

providing at least in the opening area flexible first container or conveying structure, in particular according to containers or respectively conveying structure, containing at least one first multiple coupling seal, whereby the first and/or second seal of the first multiple coupling seal is or respectively are preferably sealed, providing at least in the opening area flexible second container or conveying means, in particular according to containers or respectively conveying means, containing at least one second multiple coupling seal, whereby the first and/or second seal of the second multiple coupling seal is or respectively are preferably sealed, coupling the first seals of first and second multiple coupling seal by forming a docking system by coupling the slide, in each case comprising coupling slide elements, of the first seals of first and second multiple coupling seals, so that the first and second sealing strips of the coupling seals of the first seals of first and second multiple coupling seal can be brought to bear on one another, and joint moving of the coupled slide or coupling slide elements of the first seals of first and second multiple coupling seal along at least in each case a section of first and second sealing strip of the coupling seals of the first seals of first and second multiple coupling seals, opening of the coupled first seals of first and second multiple coupling seal while retaining an environmentally impermeable docking system by joint or time-offset moving of the zip slide of the first seals of first and second multiple coupling seals in a direction of opening from the closed position to an open position by forming an environmentally impermeable continuous opening between first container or conveying structure and second container or conveying structure, coupling of the second seals of first and second multiple coupling seal by forming a particularly environmentally impermeable, second docking mechanism, in particular by forming an inventive multiple docking device, simultaneous or successive opening of the second seals of first and second multiple coupling seal at least in sections while retaining the environmentally impermeable second docking mechanism, transferring bulk material from the first container or conveying structure to the second container or conveying structure, or vice versa, simultaneous or successive sealing of the second seals of first and second multiple coupling seal while retaining an environmentally impermeable second docking mechanism, uncoupling the second seals of first and second multiple coupling seal while separating the second docking mechanism, simultaneous or time-offset sealing of the first seal of the first multiple coupling seal and/or of the first seal of the second multiple coupling seal by joint or time-offset moving of the zip slide of the first seals of first and second multiple coupling seal in a sealing direction from the open position to a closed position by forming environmentally impermeable first seals of first and second multiple coupling seal and while retaining an environmentally impermeable docking system, and uncoupling the first seals of first and second multiple coupling seal by joint moving of the coupled slide or coupling slide elements of first and second seal along at least in each case of a section of first and second sealing strip of the coupling seals of first and second multiple coupling seal while separating the docking system.

Here it is of particular advantage that the coupling slide elements and the zip slide of the first seals of first and second multiple coupling seal are moved at the same time with forming and/or separating of the first docking system, whereby the coupling slide element and the zip slide of the seal of the first multiple coupling seal and/or the coupling slide element and the zip slide of the seal of the second multiple coupling seal are adjacent preferably indirectly or directly.

A particularly preferred further development also takes into consideration that the coupling slide element and the zip slide of the seal of the first multiple coupling seal and/or the coupling slide element and the zip slide of the seal of the second multiple coupling seal are integrated in one slide.

It is of particular advantage in the zip seal that it first enables coupled or respectively docked containers to be opened and closed unproblematically and reliably in one motion by way of actuating a slide. With the docking seals it is surprisingly simple and operationally secure to receive environmentally impermeable docking systems for flexible containers and tubes. Also, the concept of multiple coupling seals has surprisingly been further developed by integrating the inventive zip and docking seals. The seal or respectively docking systems basically succeeds in also using simple flexible containers, independently of their size, for environmentally impermeable filling and/or decanting actions, which up to now has not been possible in a correspondingly simple, uncomplicated and all the same reliable way. For operating safety and reliability as well as for maintaining the integrity of the containers and seals and docking systems used, in particular for ongoing use, it is also a factor that really only the zip slide, coupling slide elements and if necessary end stops are to be operated. Neither the sealing elements or beads nor the flexible containers are to be activated manually for closing or docking.

FIG. 1 shows in cutouts two flexible containers 50 and 52 of the preferred embodiment to be coupled in each case to meshing sealing strips 2 and 4 or respectively 2' and 4'. Both containers are consequently sealed. In addition, both containers have a combined seal 200 or respectively 202 with in each case a combined slide 100 and 102, in each case containing a zip slide and integrating a coupling slide element. A zip seal and a docking seal are joined in the combined seals 200, 202 consequently in each case. Both containers are furthermore equipped with end stops 104 or 106, which can also be used to provide a second stop point, during operation of the seal. In this way it is not necessary to hold the flexible container itself during actuation of the combined seals.

Figure 2:
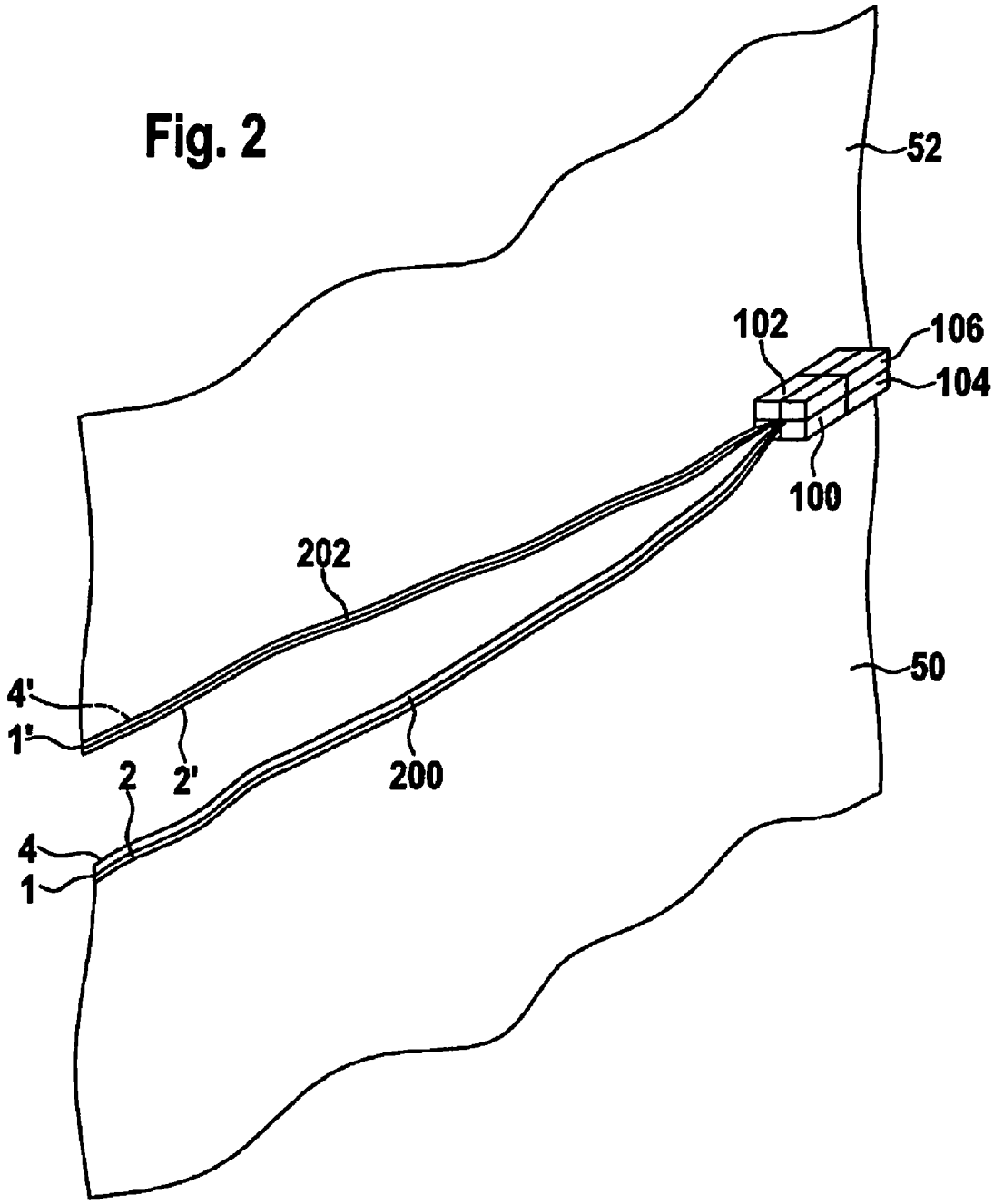
FIG. 2 illustrates the containers according to FIG. 1 at the beginning of the docking process in schematic side elevation.

The seals 200 and 202 of first and second container 50, 52 can be laid on one another via the respective outer surfaces of their sealing walls 108, 110, which preferably match one another in size and shape, as shown in FIG. 2. The outer surfaces of these sealing walls preferably have means for being meshed together (not illustrated). In this way the superimposed first and second slides 100 and 102 can be moved particularly easily and unproblematically along the sealing strips 2, 4 or 2', 4' of first and second coupling seals 1, 1'. Temporary stopping of the superimposed end stops 104 and 106 is also very effective, without the potential risk of mutual slipping of the superimposed surfaces.

Figure 3:
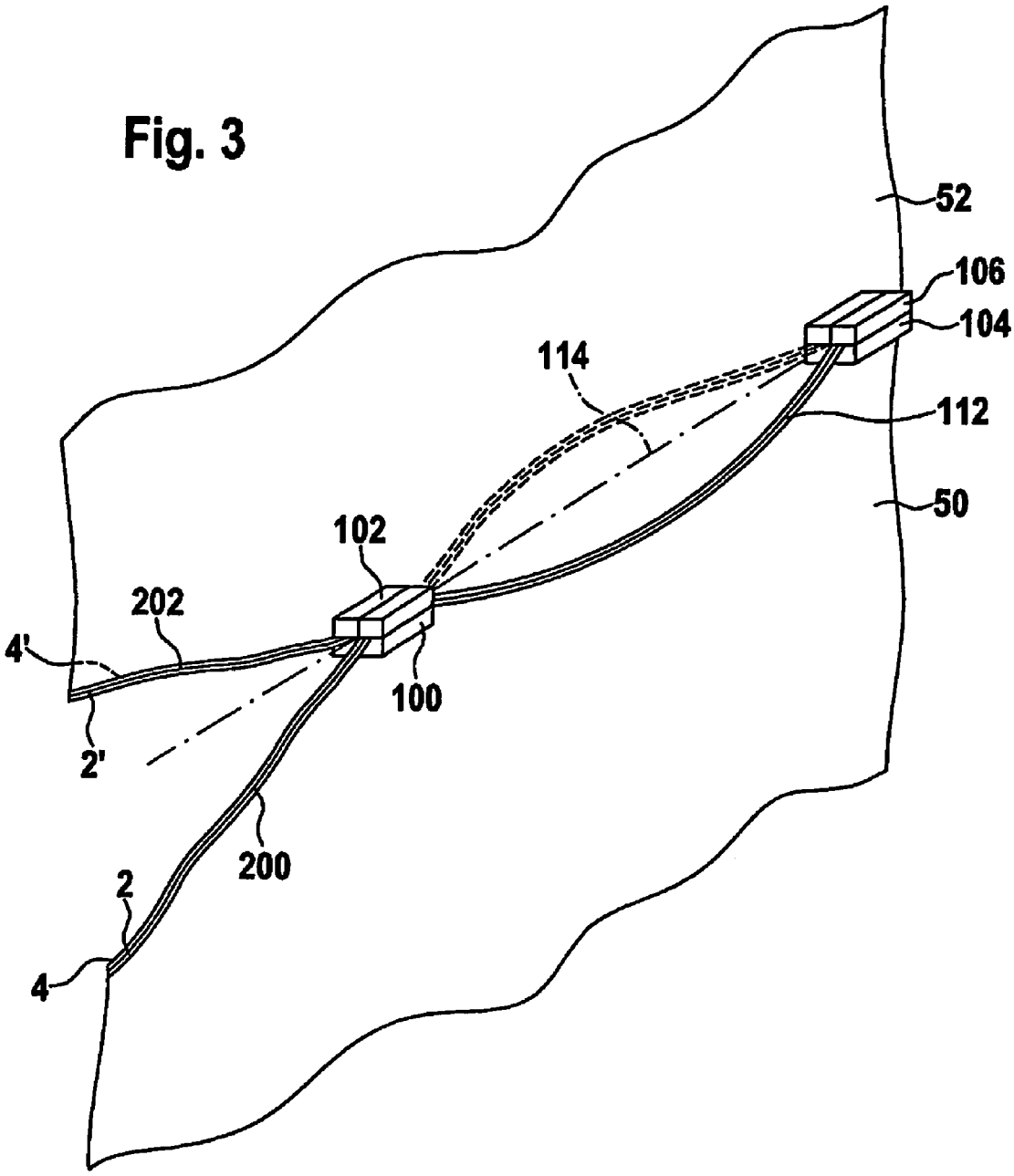
FIG. 3 illustrates the containers according to FIG. 1 in the partially docked state in schematic side elevation.

If the superimposed first and second slides 100 and 102 are moved along the sealing strips of the combined seals 200, 202 on the one hand, as shown in FIG. 3, the sealing strips 2, 4 and 2', 4' of first and second seal 200 and 202 are coupled to one another environmentally impermeably by forming a docking system 112 and on the other hand the first and second sealing strips 2, 4 of the first seal 200 as well as the first and second sealing strips 2', 4' of the second seal 202 or respectively their respective complementary sealing elements are separated from one another at the same time. When the flexible containers 50 and 52 to be coupled are docking this indirectly results in an environmentally impermeable through opening 114, provided for filling and/or decanting of bulk material. Depending on the quantity to be decanted a through opening 114 corresponding to requirements can be created by means of the seals or respectively the docking system 112.

Figure 4:
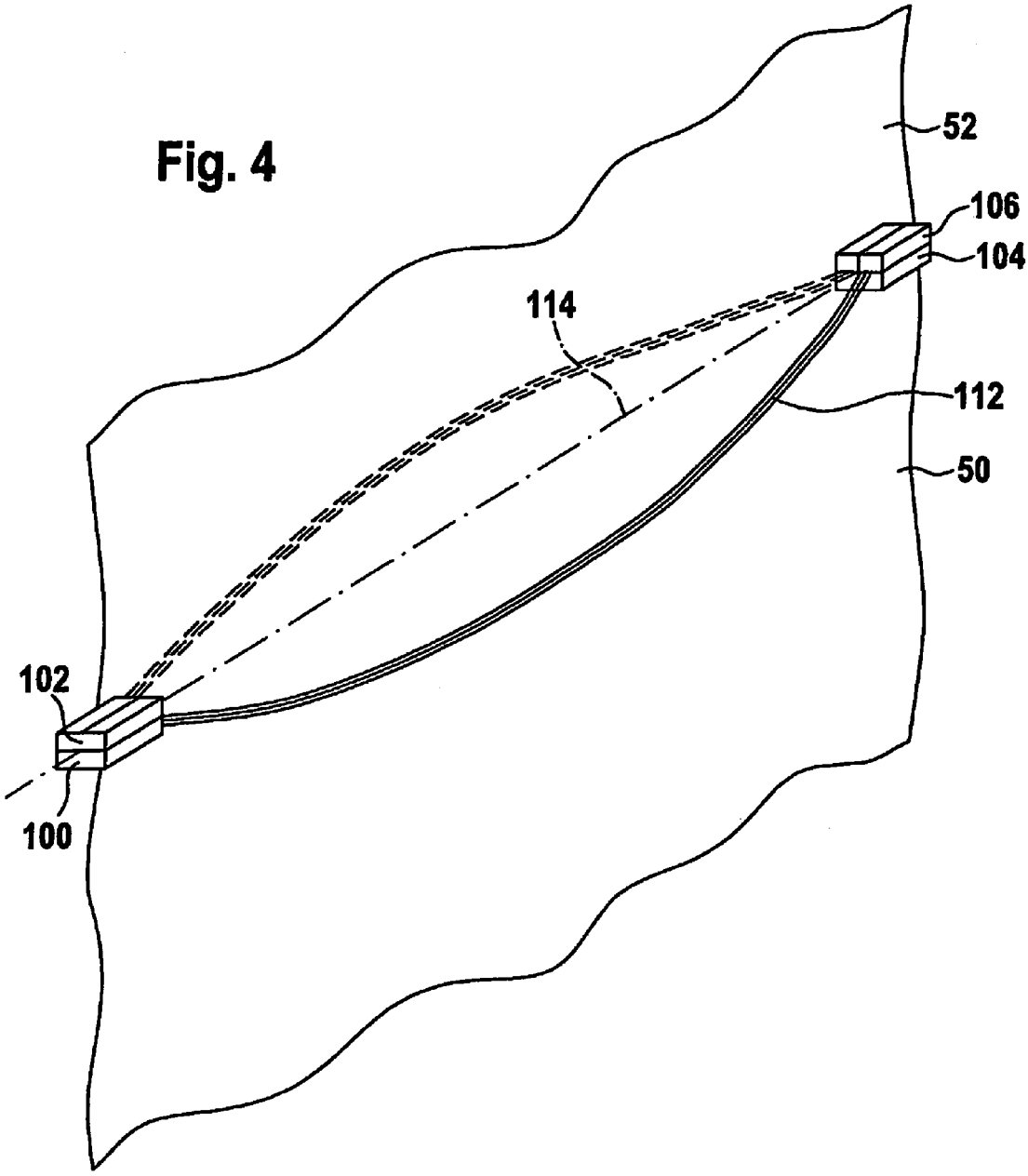
FIG. 4 illustrates the containers according to FIG. 1 in the fully docked state in schematic side elevation.

In FIG. 4 the first and second flexible containers 50, 52 have been coupled to one another over their entire opening width. With joint rearward movement of first and second combined slides 100 and 102 in the direction of the end stops 104 and 106 the first and second flexible containers 50 and 52 can be resealed and at the same time separated from one another (not illustrated).

Figure 5:
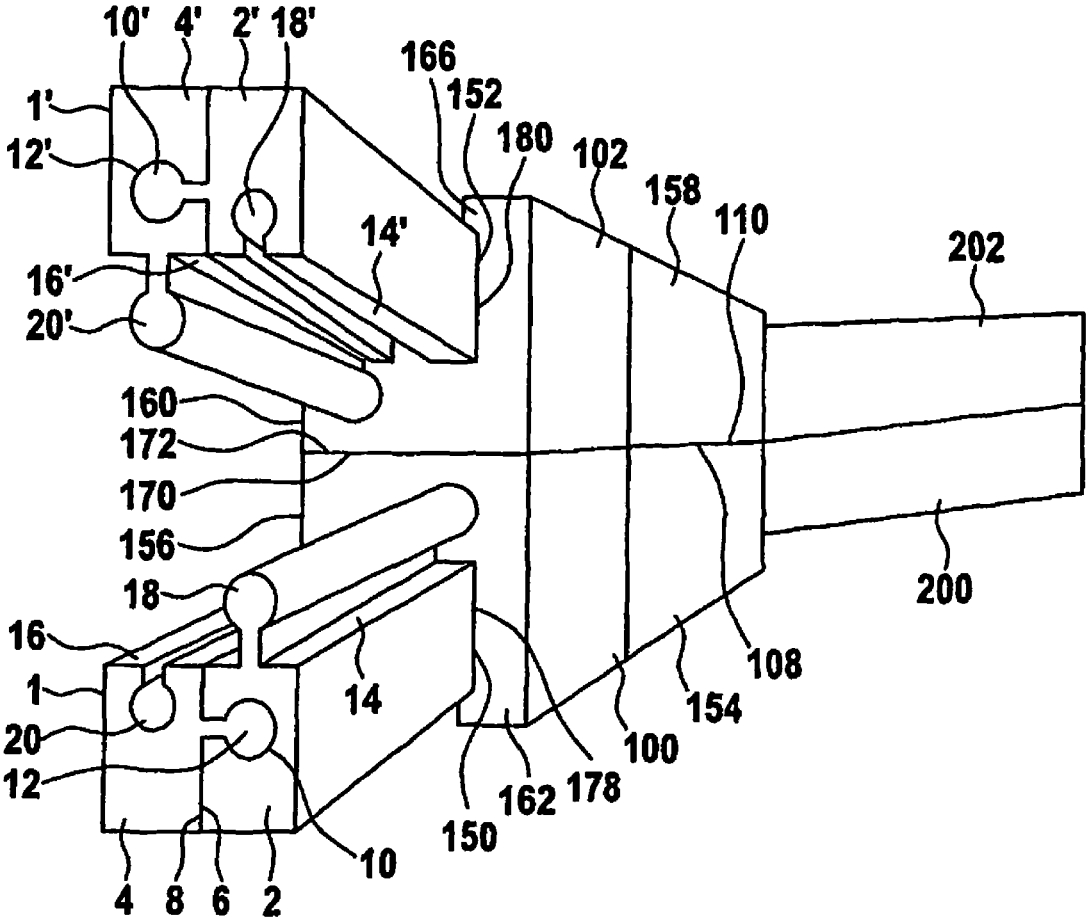
FIG. 5 illustrates a schematic perspective view of a seal of the preferred embodiment.

FIG. 5 shows two combined slides 100 and 102 superimposed via the outer surfaces of their sealing walls 108 and 110, as already shown in FIGS. 1 to 4. These slides in each case have an inlet opening 150 or respectively 152 of the guide channels 178 and 180 for meshing first and second sealing strips 2, 4 or 2', 4' of the coupling seals 1 and 1' of first and second seal 200 or 202. The slide 100 and 102 have side walls 154, 156 and 158, 160 extending from the sealing wall 108 or 110, as well as sections of wall 162 and 164 (not illustrated) and 166 and 168 (not illustrated) moving away from the side walls. At the inlet openings 150 and 152 the respective top sides 14, 14', 16, 16' of the first and second sealing strips 2, 2', 4, 4' are at a distance from the edges 170, 172 of the sealing walls 108 and 110 such that sealing elements 18 and 20' also extending from the top sides 14 and 16' in each case do not reach these edges, but a distance therefrom remains. The channel, in which the coupled first and second sealing strips are guided in the combined slide in each case, is formed such that the top sides 14, 16 and 14', 16' of the first and second sealing strips of first and second seal 200, 202 move towards one another constantly and finally meet with meshing of the complementary sealing elements 18 and 18' as well as 20 and 20' inside the superimposed combined seals. For this, the sealing walls 108, 110 of the first and second combined slide 100, 102 have to have outlets of the openings corresponding in shape and size for the desired docking to happen. Care must be taken here that the sections of wall 162, 164 or 166, 168 moving away from the side walls 154, 156 and 158, 160 are worked such that when the coupling seals 1, 1' are drawn through or moved through the combined slide there is no possibility for the sealing strips 2, 4 or 2', 4' to be removed from the docking process. For the most part it is already enough if the height of the channel 178 or respectively 180 remains unchanged, i.e. if the respective inner surfaces of the sections of wall 162, 164, 166, 168 similarly move in the direction of the outer surface of the sealing wall as that side of the channel, facing the top sides of first and second sealing strip. Apart from the docking of first and second sealing strips of first and second seals 200, 202 the present combined slides 100, 102 likewise create an opening of the respective first and second sealing strips. For this, a zip slide is in each case likewise integrated in the illustrated combined slides, apart from a coupling slide element. The separating end of this zip slide is located to the side opposite the inlet opening 150, 152, on which the separating element is also located (not illustrated). After docking of the coupling seals 1, 1' of first and second seals via the superimposed first and second combined slides 100, 102 in one procedure or in one motion the sealing elements 10 and 12 as well as 10' and 12' of first and second sealing strips 2, 2', 4, 4' can thus be separated from one another by means of separating elements. In an alternative embodiment it is of course likewise possible that a slide, which comprises a combination of a coupling slide element and a zip slide, at first the first and second sealing strips, belonging to a coupling seal, separates and after that causes coupling or respectively docking of the separated sealing strips of a container with the separated sealing strips of a second container.

Figure 6:
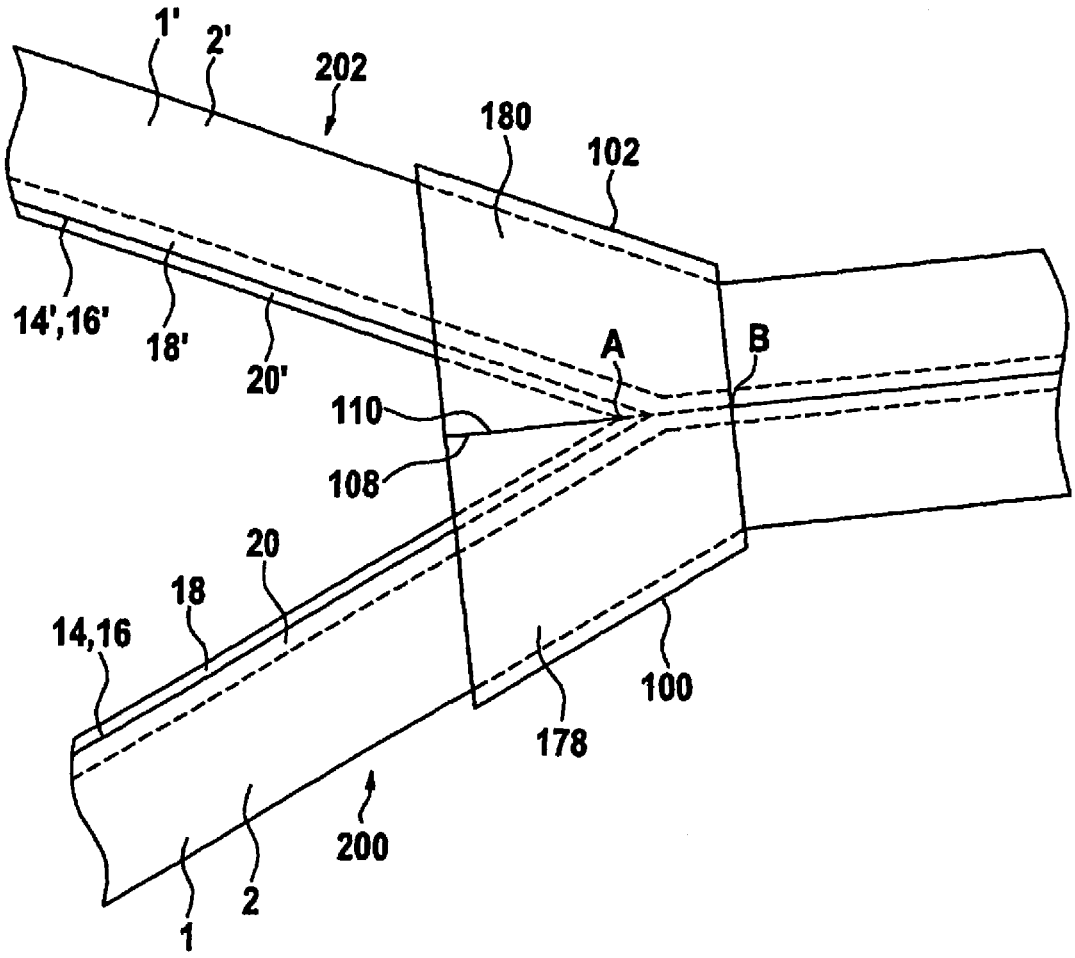
FIG. 6 illustrates a cutout of the seal of the preferred embodiment in schematic side elevation.

FIG. 6 is a schematic side elevation of the cutout according to FIG. 5. The meshing first and second sealing strips of the respective coupling seals 1 and 1' are guided to one another in the first and second coupling slide elements of the combined slides 100, 102 superimposed via their sealing walls 108 and 110. In their shape and their dimensions the channels 178, 180 of the first and second coupling slide elements match the respective coupling seals 1, 1' or the coupled first and second sealing strips. Along the stretch AB the sealing walls 108, 110 in each case have an outlet or an opening, so that there is the possibility for the top sides 14, 16 and 14' 16' of first and second sealing strips of first and second seals 200, 202 by meshing their complementary sealing elements to be able to take up the shortest possible distance or respectively be put in contact. The illustrated side elevation in each case shows the side walls of the first sealing strips 2 and 2' of the coupling seals 1 and 1'. The respective top sides of first and second coupled sealing strips 2 and 4 or 2' and 4' are indicated by edge lines 14, 16 or 14', 16'. The third sealing element 18, which is configured in the shape of a spring, rises from the surface 14. The fourth sealing element 20, which is configured in the shape of a groove, present covered in the second sealing strip 4 in the selected lateral elevation, is indicated by a dashed line. The third and fourth sealing elements 18' and 20' of first and second sealing strip 2' and 4' of the coupling seal 1' present in the shape of a groove and a spring are shown in similar fashion. In the area of the opening AB the spring 18 is then guided in the groove 18' and the spring 20' is guided in the groove 20.

Figure 7:
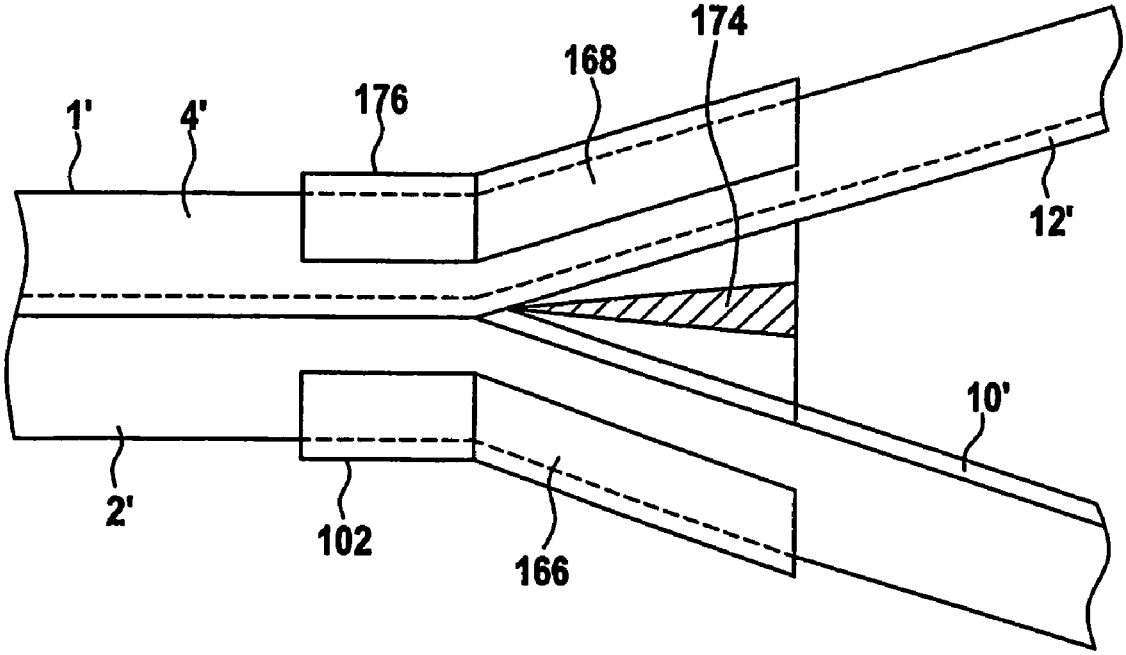
FIG. 7 illustrates a cutout of an embodiment of a seal of the preferred embodiment in schematic plan view.

FIG. 7 finally shows a plan view of the superimposed combined slide illustrated in FIG. 5. Accordingly, this shows the remote sections of walls 166 and 168 of the combined slide 102. The separating element 174 engages between the sealing elements 10', 12' of first and second sealing strips 2', 4' of the coupling seal 1' of the first seal. In similar fashion the first and second sealing strips 2, 4 of the second seal are separated from one another by a corresponding second separating element. By reversing the direction of movement of the coupled seals 200, 202 the compression end 176, matching the expansion of the coupled first and second sealing strips 2' and 4' in width, ensures that the sealing elements 10' and' of first and second sealing strip 2' and 4' mesh in one another again by forming an environmentally impermeable seal. The separating element 174 helps the first and second sealing strips 2' and 4' to draw away from one another, in that it separates the complementary first and second sealing elements 10' and 12' from one another, i.e. forces the spring 10' away from the groove 12'. Conversely, at the compression end 176 the first and second sealing elements 10' and 12' of first and second sealing strips 2' and 4' are pressed into one another flush using their complementary structure. In similar fashion the zip slide of the seal 200 can then also function.

The characteristics of the invention disclosed in the above-mentioned description, the diagrams as well as in the claims can be essential for carrying out the invention in its various embodiments both individually and also in any combination.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A reclosable coupling seal system for substantially environmentally impermeable reversible sealing as well as for substantially environmentally impermeable reversible filling and/or decanting of bulk material from a container or tube, comprising:

a coupling seal comprising first and second flexible sealing strips;

the first flexible sealing strip comprising an inner side and a top side with at least one first sealing element on its inner side;

the second flexible sealing strip comprising an inner side and a top side with at least one second sealing element on its inner side complementary to and meshable with the first sealing strip first sealing element for reversible, tight sealing of the coupling seal with the first and the second sealing strips connected to one another;

said top side of the first sealing strip having at least one third sealing element for reversible docking with a first complementary sealing element, and said top side of the second sealing strip having at least one fourth sealing element for reversible docking with a second complementary sealing element;

a zip slide for opening and closing of the coupling seal and which can be moved along the coupling seal, said zip slide having a separating end and a compression end, opposite side walls, a separating element at the separating end which can be slid between the first and second sealing elements of the first and second sealing strips, the first and the second sealing elements being meshed in reaction to movement of the zip slide in a sealing direction from an open position to a closed position, and the first and second sealing elements can be opened in reaction to movement of the zip slide in a direction of opening from the closed position to the open position.

2. A reclosable coupling seal system of claim 1 wherein the zip slide comprises an upper sealing wall as well as said opposite side walls extending downwards from opposite sides of the sealing wall and which take up the first and second sealing strips between them, the side walls running from the separating end to the compression end of the zip slide and at the compression end the side walls are spaced sufficiently closely that, when the zip slide is moved to the closed position, they press the first and second sealing elements into mutual meshing, and whereby at the separating end the separating element protrudes from the sealing wall between the side walls and between the first and second sealing elements.

3. A reclosable coupling seal system of claim 1 wherein an opening edge of said container or tube is connected to the first and second sealing strips.

4. A releasable coupling seal system of claim 1 wherein at least the inner side or the top side of the first or second sealing strips of the coupling seal have an adhesive layer.

5. A releasable coupling seal system of claim 1 wherein the zip slide has at least one operating grip and an end stop at one end of the coupling seal.

6. A releasable coupling seal system of claim 1 wherein the first and second sealing strips are substantially a same length.

7. A releasable coupling seal system of claim 1 wherein another coupling seal comprising first and second flexible sealing strips is provided for substantially environmentally impermeable reversible filling and/or decanting of bulk material from another container, and wherein said another coupling seal first sealing strip has said first complementary sealing element and said another coupling seal second flexible sealing strip has said second complementary sealing element.

8. A reclosable docking seal system for reversible docking of first and second coupling seals for substantially environmentally impermeable reversible sealing of and for substantially environmentally impermeable filling and/or decanting of bulk material from containers or tubes, comprising:

the first and the second coupling seals each comprising first and second flexible sealing strips;

the first flexible sealing strip comprising an inner side and a top side with at least one first sealing element on its inner side;

the second flexible sealing strip comprising an inner side and a top side with at least one second sealing element on its inner side complementary to and meshable with the first sealing strip first sealing element for reversible, tight sealing of the first and second coupling seals with the respective first and second sealing strips connected to one another;

said top side of the first coupling seal first sealing strip having at least one third sealing element for reversible docking with a complementary third sealing element of the topside of the second coupling seal first sealing strip, and a top side of the first coupling seal second sealing strip having at least a fourth sealing element for reversible docking with a complementary fourth sealing element of the top side of the second coupling seal second sealing strip; and a coupling slide which can be moved along the first and second coupling seals for coupling and uncoupling of the first and second sealing strips of the first coupling seal with the respective first and second sealing strips of the second coupling seal.

9. A docking seal system of claim 8 wherein each coupling seal has a combined slide comprising a zip slide which is integrated with a portion of said coupling slide, said zip slide comprising a sealing wall and opposite first and second side walls extending downwards from opposite sides of the sealing wall and which receive therebetween the first and second sealing strips, a first wall section lying opposite the sealing wall, and extending from the first side wall in a direction toward the opposite second side wall, a second wall section lying opposite the sealing wall and extending from the second side wall in a direction toward the opposite first side wall, at least one gap between the first and second wall sections, at least one guide channel for the first and second sealing strips formed between the opposite side walls and therebetween the sealing wall and the first and second wall sections, and an inlet opening of the channel at a front and a discharge opening of the channel at a rear of the zip slide.

10. A docking seal system of claim 8 further comprising at least one zip slide integrated with a portion of the coupling slide to form a combined slide, said zip slide opening and closing the first coupling seal, which can be moved along the first coupling seal, and which has a separating end and a compression end and opposite side walls as well as a separating element at the separating end which can be slid in between the first and second sealing elements, and wherein in reaction to movement of the zip slide the first and the second sealing elements can be meshed together in a sealing direction from an open position into a closed position and in reaction to movement of the zip slide in a direction of opening the first and second sealing elements can be brought out of the closed position into the open position.

11. A docking seal system of claim 8 wherein each of the coupling seals has a combined slide formed of a respective portion of the coupling slide and a zip slide, and wherein the combined slides of the first and second coupling seals are connected together at respective sealing walls so that the respective portions of the coupling slide mate together to form said coupling slide.

12. A docking seal system of claim 8 wherein the third and fourth sealing elements of the top sides of the first and second sealing strips of the first coupling seal are complementary to the third and fourth sealing elements of top sides of said first and second sealing strips of the second coupling seal, so that the respective first and second sealing strips of the first and second coupling seals can be connected reversibly to one another, and combined slides are reversibly connected to each other and contain both a respective portion of the coupling slide and a respective zip slide to close the respective first and second seals.

13. A docking seal system of claim 12 wherein the coupling slide portions are connected together to form said coupling slide.

14. A docking seal system of claim 8 wherein the first and second coupling seals each comprise a zip slide integrated with respective portions of the coupling slide, to form respective combined slides.

15. A docking seal system of claim 14 wherein with the combined slides mated together the coupling slide portions form said coupling slide, said coupling slide comprising a first guide channel receiving first coupling seal, a second guide channel receiving the second coupling seal, and a narrow compression end where the first and second coupling seals are docked together by meshing of said respective third and fourth sealing elements.

16. A docking seal system, comprising:

a first flexible enclosure having an opening end with a first coupling seal thereat;

a second flexible enclosure having an opening end with a second coupling seal thereat;

each of said first and second coupling seals comprising first and second sealing strips;

a first zip slide engageable with said first and second sealing strips of said first coupling seal for opening and closing said opening by engaging or disengaging said first and second sealing strips from one another as the first zip slide is slid along the sealing strips;

a second zip slide engaging with said first and second sealing strips of said second coupling seal for opening or closing said opening by engaging or disengaging said first and second sealing strips from one another as the second zip slide is slid along the sealing strips;

the first and second zip slides each being reversibly connectible and each containing a respective portion of a coupling slide to form respective combined slides, the coupling slide formed by the connectible respective coupling slide portions engaging or disengaging the first and second coupling seals as the coupling slide is slid along the first and second combined seals so as to dock or separate the first and second flexible enclosures from one another;

the first sealing strip of the first and second coupling seals comprising a first sealing element at a side and a third sealing element at a top and the second sealing strip of the first and second coupling seals comprising, a second sealing element at a side and a fourth sealing element at a top;

for closing the first and second coupling seals, the first sealing element of the first sealing strip engaging with the second sealing element of the second sealing strip; and for engaging the first sealing strip of the first coupling seal with the first sealing strip of the second coupling seal the third sealing element of the first coupling seal first sealing strip engaging with the third sealing element of the first sealing strip of the second coupling seal, and for engaging the second sealing strip of the first coupling seal to the second sealing strip of the second coupling seal the fourth sealing element of the first coupling seal second sealing strip engaging with the fourth sealing element of the second coupling seal second sealing strip.

17. The system of claim 16 wherein the first and second zip slides each comprise a compression end and a separating end, said separating end having a separating element.

18. The system of claim 16 wherein said first and second flexible enclosures each comprise a flexible container.

19. A system of claim 16 wherein said first and second enclosures each comprise a flexible tube.

20. A method for opening and closing a respective opening end of first and second enclosures and also for docking said first and second enclosures together at said respective opening ends in a releasable manner, comprising the steps of:

providing said first and second enclosures at said respective opening ends with respective first and second coupling seals each comprising respective first and second sealing strips;

providing a first zip slide which slides along the first coupling seal to engage or disengage the respective first and second sealing strips to open or close the opening end of the first enclosure by use of respective sealing elements meshing with each other;

providing a second zip slide which slides along the second coupling seal to engage or disengage the respective first and second sealing strips to open or close the opening end of the second enclosure by use of respective sealing elements meshing with each other;

docking the opening ends of the first and second enclosures to each other by combining the first and second zip slides with respective portions of a coupling slide to form respective combined slides which, when slid along both the first and second coupling seals, join the first sealing strips together by complementary sealing elements and loin the second sealing strips together by complementary sealing elements; and providing the first sealing strip of each of the first and second coupling seals with a first sealing element at a side and a third sealing element at a top and providing each of the second sealing strips of the first and second coupling sleeves with a second sealing element at a side and a fourth sealing element at a top.

21. A method of claim 20 including the step of mating the combined slides together at respective sealing walls so that said coupling slide portions combine to form said coupling slide.

* * * * *